US005479798A

United States Patent [19]

Müller

[11] Patent Number: 5,479,798

[45] Date of Patent: Jan. 2, 1996

[54] PROCESS FOR MANUFACTURING LOCKET-HALVES

[76] Inventor: Manfred Müller, Steinenlandstrasse 14, D-7530 Pforzheim-Eutingen, Germany

[21] Appl. No.: 50,218

[22] PCT Filed: Oct. 19, 1991

[86] PCT No.: PCT/EP91/01990

§ 371 Date: Apr. 27, 1993

§ 102(e) Date: Apr. 27, 1993

[87] PCT Pub. No.: WO92/07484

PCT Pub. Date: May 14, 1992

[30] Foreign Application Priority Data

Oct. 27, 1990 [DE] Germany ..... 40 34 288.3

[51] Int. Cl.[6] ..... A44C 15/00

[52] U.S. Cl. ..... 63/19; 29/160.6

[58] Field of Search ..... 29/160.6; 63/18, 63/19

[56] References Cited

U.S. PATENT DOCUMENTS

| | | | |
|---|---|---|---|
| 720,798 | 2/1903 | Giguere | 63/18 |
| 1,255,870 | 2/1918 | Foster | 63/18 |
| 2,377,816 | 6/1945 | Slain . | |
| 2,396,214 | 3/1946 | Tabellario | 63/18 |
| 2,501,917 | 3/1950 | Reilly | 63/18 |
| 3,025,820 | 3/1962 | Rosenthal | 29/160.6 |
| 3,140,796 | 7/1964 | Broida . | |
| 3,618,338 | 11/1971 | Sauer . | |
| 3,686,894 | 8/1972 | Handler et al. | 63/19 |

FOREIGN PATENT DOCUMENTS

| | | | |
|---|---|---|---|
| 1833095 | 6/1961 | Germany . | |
| 1557606 | 4/1970 | Germany . | |
| 8702730 | 4/1987 | Germany . | |
| 8630782 | 6/1987 | Germany . | |
| 1264 | 1/1925 | United Kingdom | 63/18 |
| 825076 | 12/1959 | United Kingdom . | |

*Primary Examiner*—Michael J. Milano
*Attorney, Agent, or Firm*—Dvorak and Traub

[57] ABSTRACT

The process for producing locket-halves where a locket-half shell is formed from a first sheet, an annular groove is stamped into a second sheet, the external diameter of the groove being substantially the same as that of the locket-half shell. The portion of the sheet enclosed by the inner edge of the groove of the second sheet is removed to form a perforated plate, the locket-half shell is soldered to the perforated sheet, and the part of the second sheet extending beyond the outer edge of the groove of the sheet after the groove is stamped on is then separated.

15 Claims, 2 Drawing Sheets

PROCESS FOR MANUFACTURING LOCKET-HALVES

TECHNICAL SCOPE

The invention relates to a locket and a process for the manufacturing of locket-halves for decorative purposes.

STATE OF THE ART

From DE-GM 87 02 730 is known a locket consisting of two half-shells, for which the pre-manufactured locket half-shells and a flat annular frame are soldered to each other. This frame imparts to the locket half-shell the required rigidity and it is therefore thicker than the wall of the locket half-shells. In the case of lockets that are stamped with data on the precious metal content (fineness), relatively too much precious metal is used for the ring. Because the frame is essentially not visible due to being mainly inside the locket, this represents a waste of precious metal.

From GB-PS 825,076 is known a locket, of which the half-shells are manufactured by forming a locket half-shell from a first sheet, the forming of a flanged ring from a second sheet, the inserting of the flanged ring as frame into the locket half-shell and securing it therein by crimping the edge of the locket half-shell around the edge of the flange of the flanged ring. The disadvantage of this process is that also for the thus manufactured locket, relatively too much precious metal is used for the frames located on the inside and that the manufacture is costly. This is because the frames are joined strictly mechanically to the corresponding half-shell, namely by flanging the inside edge of the frame so that it can rest on the locket half-shell, and by crimping the edge of the locket half-shell so that it embraces and holds fast the outer edge of the frame.

DESCRIPTION OF THE INVENTION

The invention has the object to create a simple and cost-effective locket and a process for the manufacture of locket-halves.

According to the invention, this object is solved by a process for the manufacture of locket-halves by forming a locket half-shell from a first sheet, by stamping into a second sheet an annular groove, whose external diameter essentially corresponds to the external diameter of the locket half-shell, by removing the part of the sheet encompassed by the inner edge of the groove of the second sheet, so as to form a perforated sheet, by placing the half-shell with its rim into the groove, by soldering the rim of the half-shell to the perforated sheet, and by separating the part of the sheet that extends beyond the outer edge of the groove after the stamping in of the groove. According to the invention, the locket consists of two half-shells that are joined to each other in a hinged manner for its opening and closing, each half being reinforced by an annular frame soldered to the rim of the half-shells, this frames essentially presenting a U-section.

Further advantageous embodiments of the invention are object of the subclaims.

The manufacturing process, according to the invention, starts with a sheet out of precious metal or a precious metal alloy, especially out of gold, silver and their alloys. A locket half-shell is formed from a first sheet. An annular groove is stamped into a second sheet, the external diameter of the groove being essentially the same as that of the locket half-shell. The part of the sheet encompassed by the inner edge of the groove, raised in respect to the groove, is removed because it is not needed. In this way a perforated sheet is created. Subsequently, the locket half-shell is placed with its rim in the groove and soldered therein to the perforated sheet. The perforated sheet is particularly advantageously formed because the locket half-shell, whose diameter coincides with the external diameter of the groove, is correctly positioned and held fast in the groove for the soldering process. Special positioning or adjusting work is superfluous. The perforated sheet with its locket half-shell inserted in the groove can be automatically soldered in a furnace, in particular in a continuous furnace. For this, the groove serves not only for positioning and holding the locket half-shell in place, but also for filling it with solder, which can be inserted in the groove optionally in the form of soldering foil, wire, pellets or powder. This process does not require that soldering metal be evenly applied beforehand along the rim of the locket half-shell, because it melts in the furnace, runs into the groove and spreads evenly in it. No loss of soldering metal can occur because the groove retains it. Because the soldering material spreads evenly in the groove, not much soldering material is required which, on one hand, keeps the cost of the soldering material low and, on the other hand, reduces the percentage of the base metal which is advantageous for observing a predetermined fineness of the locket. The determination of the fineness of the locket takes into account as well all of its non-solvable compound materials, that is to say, also the soldering metal. In particular, it is not necessary to work with a soldering paste that is, according to the state-of the-art, applied along the rim of the locket half-shell.

The groove can be formed slightly inclined towards its outer edge; this has the advantage that the soldering metal preferably collects at the outer edge of the groove, that is to say, where it is necessary to solder the rim of the locket half-shell.

Preferably, the groove is formed slightly narrower than the locket half-shell so that the locket half-shell can be inserted into the groove under prestress and that, during the soldering process, it is also seated in the groove under prestress. This facilitates the handling of the perforated sheet with the inserted locket half-shell, while they are not yet soldered to each other, because the locket half-shell is clamped in the groove and cannot slide out while being handled. Furthermore, while being soldered, the rim of the locket half-shell is constantly pressed against the outer lower edge of the groove, so that an unobjectionable soldering joint can be obtained even with a minimum quantity of soldering material.

The portion of the sheet extending beyond the outer edge of the groove can be separated after the soldering process, but it can also be cut off prior to the insertion of the locket half-shell. It is preferred, however, to separate it after the soldering process because in this case the extending sheet can be used for the handling process and it can be cut off anyway after the soldering process so that, at least in part, the outer wall of the groove is also removed. However, this outer wall can be so thin and low that, even if it is not separated, it would not spoil the neat appearance of the locket. Because during the soldering process the soldering metal spreads also in the narrow gap between the outer wall of the groove and the locket half-shell, the outer wall of the groove is always firmly joined to the locket half-shell. The thus enlarged soldering surface increases the firmness of the bond between the rim of the locket half-shell and the thereto soldered-on annular frame, and it improves the rigidity of the rim of the locket half-shell.

If, on the other hand, the outer wall of the groove is separated even in part, this results in a saving of precious metal and the outside appearance remains unchanged.

The bent annular frame soldered on in such a manner to the rim of the locket half-shell strengthens the rim of the locket half-shell extremely well. Therefore, the sheet from which this frame is formed can be thinner than in the known state-of-the-art, which, in turn, results in a further saving of precious metal. The frame can be especially thin if a relief is embossed into the base of the groove. This can be accomplished in one only operation with the forming of the groove itself, without requiring a special tool. Of course, the relief could also be embossed in a separate operation but this would entail a higher cost. The relief reinforces the groove and thus the future frame of the locket half-shell. In comparison with a groove into which no relief is embossed, the same rigidity and solidity is attained, in the case of an embossed relief, with a considerably thinner sheet. An additional special advantage is that the relief not only increases the rigidity and solidity of the locket half-shell but, furthermore, that it can improve the neat appearance and the usefulness of the locket by choosing, e.g., decorative flower wreaths or other decorations or lettering which would express an appropriate statement for the locket. In such manner, one combines the technical and aesthetic effects.

Just as the relief has a wealth of design possibilities, the shape of the locket contour also has numerous possibilities, such as, e.g., being round, oval, heart-shaped or octagonal; for all of these shapes it is possible to stamp the groove into the second sheet. By means of the process according to the invention, the selection of the shapes of the locket-halves has no limitations.

By using only combination tool, one can stamp the groove into the second sheet, provide it with the desired relief and, subsequently, punch out the portion of the sheet encompassed by the inner edge of the groove. Thus, the manufacture of the perforated sheet requires only a low expenditure of labor. Using the same combination tool, it would also be possible to crop the part of the sheet extending beyond the outer edge of the groove, unless one prefers to leave it until after the soldering process.

The preferred method for the stamping is by means of deep-drawing, a well-known, problem-free technique.

When stamping the groove into the second sheet, it is preferred to simultaneously stamp into its outer wall a salient by way of continuation of the groove, and to punch a central hole into the bottom of this salient. In such a manner, an eyelet is already formed during the stamping of the groove, from which can be hung the locket; no special operation is necessary for the forming of the eyelet.

In a similar manner, a hinge element can be simultaneously formed with the stamping in of the groove, by stamping into the outer wall of the groove another salient at a different point of its circumference. After the subsequent separation of the outer wall delimiting the salient, the remaining tongue can be rolled into a hinge sleeve into which is inserted the hinge pin. It is more advantageous, however, to coat the salient with the soldering metal and during the soldering process solder onto it a pre-manufactured hinge element; thus, other operations for the forming of the hinge are not necessary, save for the insertion of the hinge pin. In order to facilitate coating the salient with the soldering metal, in the thereto intended salient is provided a depression in circumferential direction, which can also be impressed by the operation that forms the groove. This depression can also partially surround the pre-manufactured hinge element. This depression also facilitates the rolling process if the salient should be directly rolled to form a hinge sleeve.

Another possibility for forming the hinge consists in first coating the additional salient of the groove with a layer of solder, which can be done during the soldering process, and subsequently to partially rout this layer of solder, so as to form a salient running tangential to the groove, which can then be rolled into a hinge sleeve. By applying this layer of soldering metal, the sheet is reinforced at this spot; therefore, it imparts sufficient rigidity to the hinge.

Because the outer wall of the groove is only necessary to accomodate the rim of the locket half-shell and the soldering metal, it is advantageous to make this wall as low as possible; on the other hand, the inner wall of the groove is formed preferably higher by the stamping process; the height depends on the curvature of the locket shell and on the required distance of the edge of the groove's inner wall to the locket shell; however, the wall can be so high that it abuts on the locket shell unless an insert should be placed behind it.

A locket is formed by locket-halves manufactured according to the invention by joining both halves in swingable manner.

BRIEF DESCRIPTION OF THE DRAWINGS

An embodiment of a locket-half according to the invention is illustrated in its individual procedure steps in the accompanying drawings, in which.

HOW TO PUT THE INVENTION INTO PRACTICE

Figure 1:
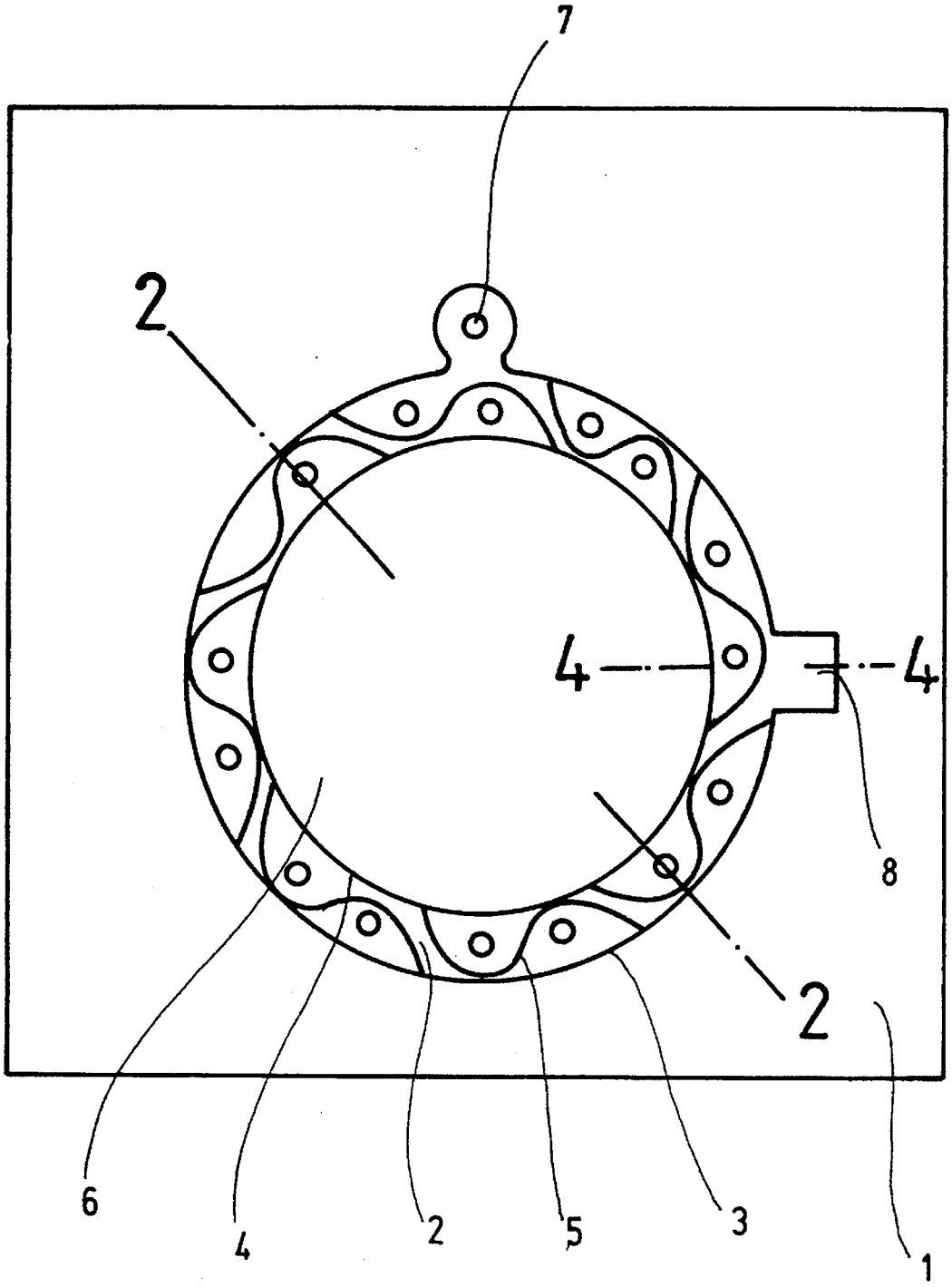
FIG. 1 shows the stamped sheet.

FIG. 1 illustrates a sheet 1 into which was stamped an annular groove 2. This annular groove 2 divides the sheet 1 into an outwardly extending portion of the sheet 1 and a raised area 6 encircled by groove 2. The wall 3 at the outer edge of groove 2 forms the limiting line to the extending portion of the sheet 1; preferably, it is only 0.2 to 0.35 mm high. A relief is embossed into the base of groove 2. The wall 4 at the inner edge of groove 2 is higher than the wall 3 at the outer edge of groove 2. The wall 4 at the inner edge of groove 2 is higher than the wall 3 at the outer wall of groove 2. Groove 2 is preferably 1 to 3 mm wide; it presents two salients 7 and 8. Salient 7 is formed as an eyelet for the fastening of a chain and, in subsequent steps, the second salient 8 is formed as a part of the hinge, which joins the two locket-halves in a hinged manner.

Figure 2:
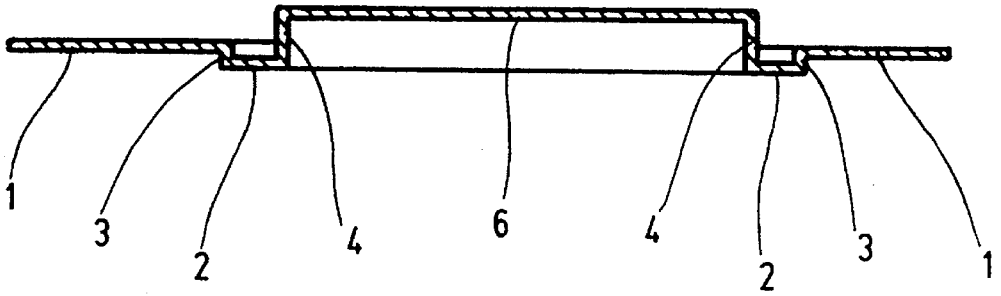
FIG. 2 shows a sectional view of this sheet along the line A—A according to FIG. 1.

FIG. 2 illustrates the section of the sheet 1 along the line A—A. The differences in height between the extending portion of the sheet 1, the annular groove and the raised inner area 6 can be distinctly recognized. The view of relief 5 in the base of groove 2 was omitted for the sake of clarity. The wall 3 at the outer edge of groove 2 connects the extending portion of the sheet 1 with the base of groove 2. This outer wall is not as high as the inner wall 4, which connects the base of groove 2 with the raised inner area 6.

Figure 4:
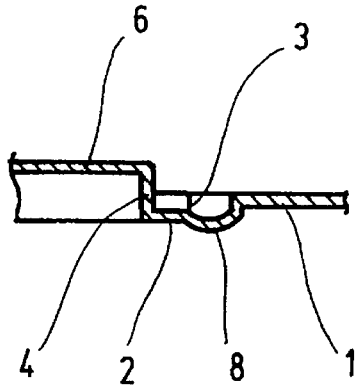
FIG. 4 shows a detail of the section B—B of the stamped sheet illustrated in FIG. 2.

To manufacture a locket-half, the inner area 6 of the sheet 1 illustrated in FIGS. 1, 2 and 4 is punched out, a premanufactured half-shell 9 (FIG. 3) is placed with its rim into groove 2, soldering metal is added, and then soldered. Subsequently, the outward extending portion of the sheet is cut off.

Figure 3:
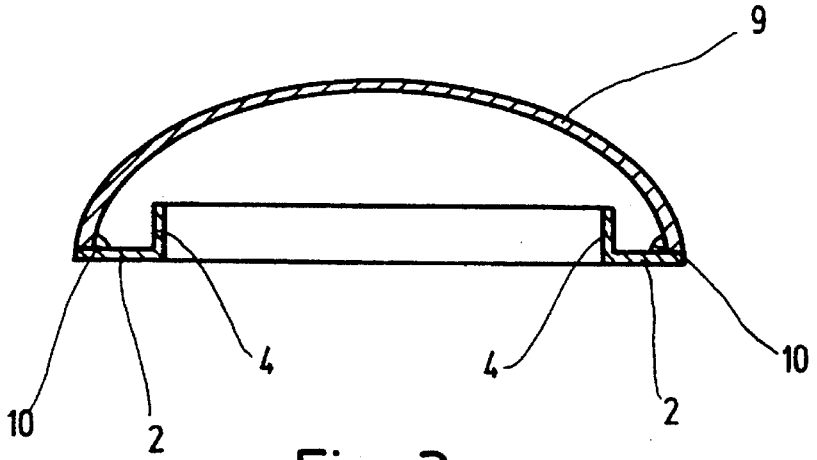
FIG. 3 shows a sectional view of a locket-half along line corresponding to the line A—A illustrated in FIG. 1.

FIG. 3 illustrates a section of the finished locket-half corresponding to the line A—A. Of sheet 1 remains groove 2, which forms a frame that strengthens the locket half-shell 9. The sheet of groove 2 can be very thin, thinner than 0.15 mm. Preferably, the sheet of groove 2 has thickness of only 0.14 mm. The sheet 1 becomes thinner by the stamping process. In order to obtain a thickness of 0.14 mm in its final condition, a sheet 1 is used which in its initial state is approximately 0.175 mm thick.

As salients of the frame, that is soldered to the locket half-shell 9, it is provided with an eyelet 7 and a tongue 8 that presents a depression 10, running tangentially to the locket circumference, whose surface is cylindrical and to which can by soldered a hinge sleeve (FIG. 4).

Industrial Applicability

The invention improves and reduces the cost of the industrial manufacture of lockets, and increases their rigidity.

What is claimed is:

1. A process for the manufacture of locket-halves comprising the steps of:

forming a locket half-shell from a first sheet having a rim and a first exterior diameter;

stamping into a second sheet an annular groove with a second exterior diameter substantially the same as the first exterior diameter of the locket half-shell, the annular groove having an inner wall at an inner edge which inner wall forms an inner portion, and an outer wall at an outer edge;

separating the inner portion of the second sheet encircled by the inner edge of the annular groove to form a perforated sheet;

inserting the rim of the locket half-shell into said annular groove of the perforated sheet;

soldering the rim of the locket half-shell to the perforated sheet: and separating an extending portion of the second sheet extending beyond the outer edge of the groove alter the stamping of the annular groove.

2. A process according to claim 1 wherein the stamping is done by deep-drawing.

3. A process according to claim 1 wherein the extending portion of the sheet is separated after the soldering process.

4. A process according to claim 1 wherein during the stamping of the groove a salient is stamped into its outer wall which is provided with a hole to form an eyelet.

5. A process according to claim 1 wherein the inner portion of the second sheet is punched out in such a manner that the inner wall of the groove remains either wholly or in part.

6. A process according to claim 1 wherein through the stamping process, the inner wall of the annular groove is formed higher than the outer wall.

7. A process according to claim 1 wherein the extending portion of the sheet extending beyond the outer edge of the groove is separated in such a manner that it leaves intact the outer wall of groove.

8. A process according to claim 1 wherein the sheet extending beyond the groove is separated after being soldered to the locket half-shell in such a manner that the outer wall of the groove is separated.

9. A process according to claim 1 wherein during the stamping of the annular groove a second salient is formed at the outer wall of the annular groove for the forming of a hinge element.

10. A process according to claim 9 wherein the second salient is stamped in such a manner that its base presents a tangentially running depression.

11. A process according to claim 9 wherein on the base of the second salient is applied a layer of solder, which is subsequently partially routed tangentially to the annular groove at a certain distance from it.

12. A process according to claim 1 wherein a relief is embossed into the groove.

13. A process according to claim 1 wherein the annular groove is formed slightly narrower than the locket half-shell so that the locket half-shell is inserted into groove under a prestress.

14. A process according to claim 4 wherein during the stamping of the groove a second salient is formed at the outer wall of the groove to form a hinge element.

15. A process according to claim 14 wherein the inner portion of the second sheet is punched out in such a manner that the inner wall of the groove remains either wholly or in part.

* * * * *